US005429570A

United States Patent [19]

Beyer

[11] Patent Number: 5,429,570

[45] Date of Patent: Jul. 4, 1995

[54] FREE WEIGHT EXERCISE DEVICE

[76] Inventor: Eric L. Beyer, 1716 Old Wheatland Rd., Vincennes, Ind. 47951

[21] Appl. No.: 172,844

[22] Filed: Dec. 23, 1993

[51] Int. Cl.[6] ..... A63B 13/00

[52] U.S. Cl. ..... 482/104; 482/106

[58] Field of Search ..... 482/148, 104–108, 482/908, 904, 133, 142

[56] References Cited

U.S. PATENT DOCUMENTS

| | | | |
|---|---|---|---|
| 4,407,495 | 10/1983 | Wilson . | |
| 4,456,246 | 6/1984 | Szabo . | |
| 4,477,074 | 10/1984 | Bushnell | 482/104 |
| 4,529,198 | 7/1985 | Hettick, Jr. | 482/104 |
| 4,648,595 | 3/1987 | Selle . | |
| 4,722,522 | 2/1988 | Lundgren . | |
| 4,730,828 | 3/1988 | Lane . | |
| 4,809,972 | 3/1989 | Rasmussen et al. . | |
| 4,822,034 | 4/1989 | Shields . | |
| 4,894,384 | 11/1988 | Deola . | |
| 4,890,831 | 1/1990 | Craig | 482/104 |
| 4,982,957 | 1/1991 | Sheilds | 482/104 |

*Primary Examiner*—Richard J. Apley
*Assistant Examiner*—Jerome Donnelly
*Attorney, Agent, or Firm*—Allegretti & Witcoff, Ltd.

[57] ABSTRACT

An exercise device for use with free weight plates. A weight lifting bar has a length sufficient to provide for two hand lifting of the bar. The weight lifting bar is supported by a support structure. A mechanism is operatively connected to and associated with the weight lifting bar, storage bars for storage of the free weight plates, and the weight lifting bar support structure. The mechanism causes the storage bars and the weight lifting bar to occupy positions of alignment and proximity of the storage bars with the weight lifting bar, when desired. Free weight plates may be moved manually off the weight lifting bar into storage on the storage bars, and alternatively, moved manually off the storage bars and onto the weight lifting bar, by sliding of the free weight plates along the storage bars and along the weight lifting bar while the storage bars and weight lifting bar are in alignment and proximity with each other.

12 Claims, 2 Drawing Sheets

Fig.1
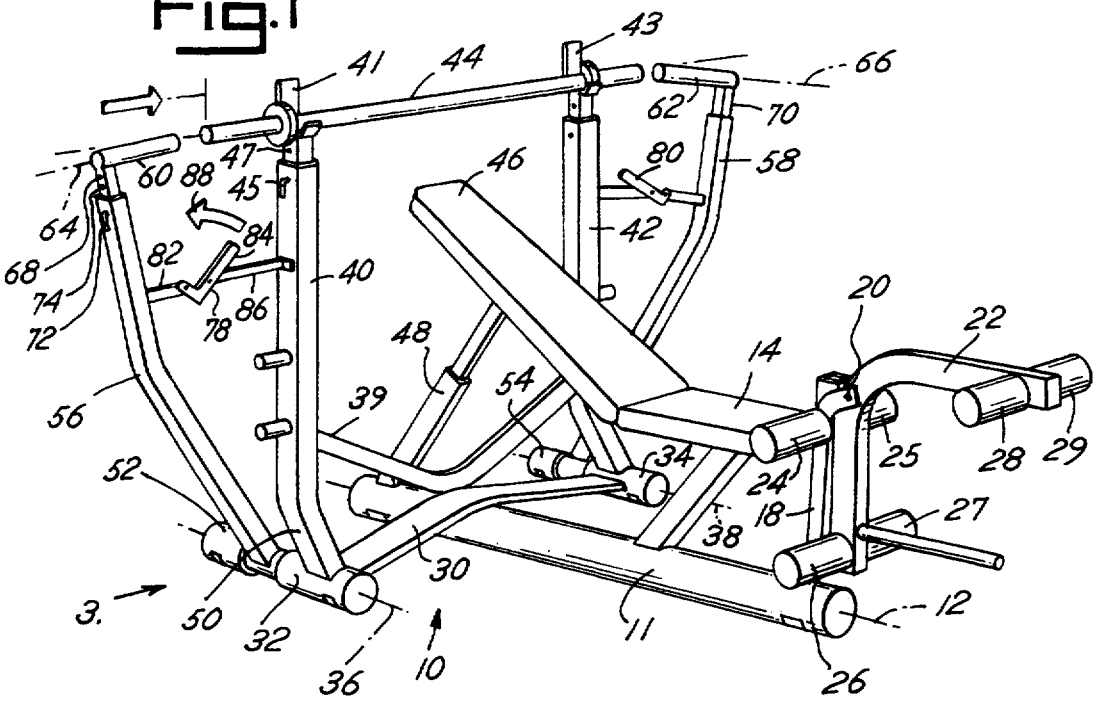
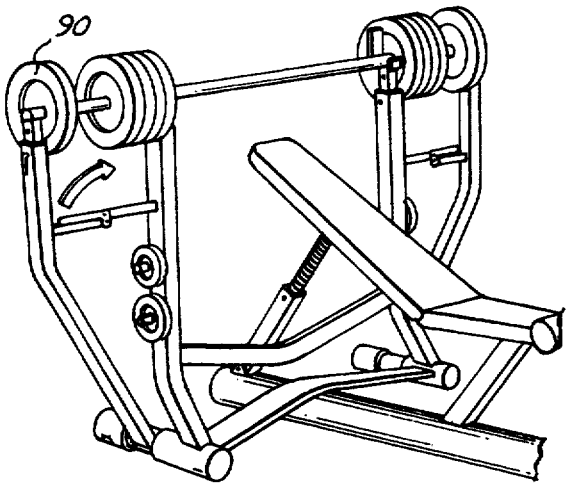
Fig.2
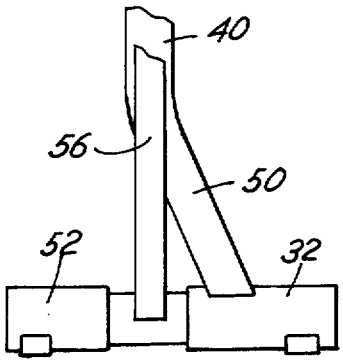
Fig.3

FREE WEIGHT EXERCISE DEVICE

BACKGROUND OF THE INVENTION

This invention relates to weight lifting equipment, and more particularly, to the devices and mechanisms by which weights are placed on and removed from weight lifting bars, and stored.

In the beginnings of weight lifting, barbells were provided with free weights which took the form of plates, and the barbells were lifted with the number of weight plates desired, while remaining plates were left scattered on the floor or in stacks. As weight training has become progressively more sophisticated, and issues of product performance and liability have intruded, weight training equipment has taken a variety of new forms. Universal gyms now exist, which provide multitudes of weight training stations with weights pulled from stacks by wires over pulleys. An example of one such structure is shown in U.S. Pat. No. 4,809,972 issued on Mar. 7, 1989 to Rasmussen et al. Another example is shown in U.S. Pat. No. 4,784,384 issued on Nov. 15, 1988 to Deola. Sophisticated devices dedicated to individual exercises and muscles have also come to exist. Examples are shown in U.S. Pat. No. 4,722,522 issued on Feb. 2, 1988 to Lundgren, U.S. Pat. No. 4,456,246 issued on Jun. 26, 1984 to Szabo, U.S. Pat. No. 4,730,828 issued on Mar. 15, 1988 to Lane, and U.S. Pat. No. 4,407,495 issued on Oct. 4, 1983 to Wilson.

A significant population of weight lifters have always preferred and continue to prefer free weights. Yet, as to free weights, issues of safety are often paramount. Concern for safety has resulted in inventions such as shown in U.S. Pat. No. 4,648,595 issued on Mar. 10, 1987 to Selle, for safety platforms for a free weight bench press. Safety concerns often r around weight lifter handling of weights while the weights are detached from weight, equipment, while the weight lifters are moving the weights into and out of attachment for lifting. Such concerns resulted in the invention of U.S. Pat. No. 4,822,034 issued on Apr. 18, 1989 to Shields. In the barbell system of Shields, multiple weights are racked adjacent a bench press, and the bar used in the bench press is rolled into slots in the racked weights. Chosen weights are pinned to the bar, the bar is rolled back to weight lifting position, and weight lifting begins.

As evident from the multiple solutions of the prior art to safety concerns, safety has been for years and continues to be a goal not fully satisfied in the art. Further, safety concerns have resulted in compromises of the freedoms of free weights, and complicated structures which include weights incompatible with standard disc shaped free weights, as is true in U.S. Pat. No. 4,822,034 to Shields.

Also, in these times of the global marketplace, worldwide shipments of goods are to be expected, and are desired. Incompatibility of weights with standard free weights means that each weight lifting device with such incompatibility requires shipment of weights. Such shipments are inconsistent with global needs.

SUMMARY OF THE INVENTION

Given the state of and concerns of the art, an object of the present invention is to provide an exercise device and system which merges features of freedoms of free weights, compatibility with standard free weight plates, safety, and convenience and speed of weight manipulation and adjustment, and similar desirable features.

Another object of the invention is to maximize features as described, to every extent possible and beyond the accomplishments of the prior art.

A third object is to accomplish the foregoing in a device and system, and in mechanisms, which are not "Rube Goldberg" in their complication, which do not require complicated maneuvers and manipulations, and which result in products salable at reasonable prices to the benefit of the health and well-being of the populace.

Thus, in a principal aspect, the present invention encompasses an exercise device for use with free weight plates. In the invented device, a weight lifting bar has a length sufficient to provide for two hand lifting of the bar. A weight lifting bar support structure supports the weight lifting bar. Storage bars provide for storage of the free weight plates. A mechanism is operatively connected to and associated with the weight lifting bar, the storage bars, and the weight lifting bar support structure, for causing the storage bars and the weight lifting bar to occupy positions of alignment and proximity of the storage bars with the weight lifting bar, when desired. Free weight plates may be moved manually off the weight lifting bar into storage on the storage bars, and alternatively, moved manually off the storage bars and onto the weight lifting bar, by sliding of the free weight plates along the storage bars and along the weight lifting bar while the storage bars and weight lifting bar are in alignment and proximity with each other.

The foregoing and other objects, aspects and advantages of the invention more fully appreciated by a reading of a detailed description of the invention and its preferred embodiments, which follows a brief description of the accompanying drawing.

BRIEF DESCRIPTION OF THE DRAWING

FIG. 1 is a perspective view of a first preferred embodiment of the invention, shown without weights for clarity, in the open or lift mode.

FIG. 2 is a perspective view similar to FIG. 2, with weight plates in place and with the device of the embodiment in a closed or adjust mode.

FIG. 3 is a broken away, side elevation view taken from along arrow 3 in FIG. 1.

DETAILED DESCRIPTION OF THE PREFERRED EMBODIMENT

Figure 4:
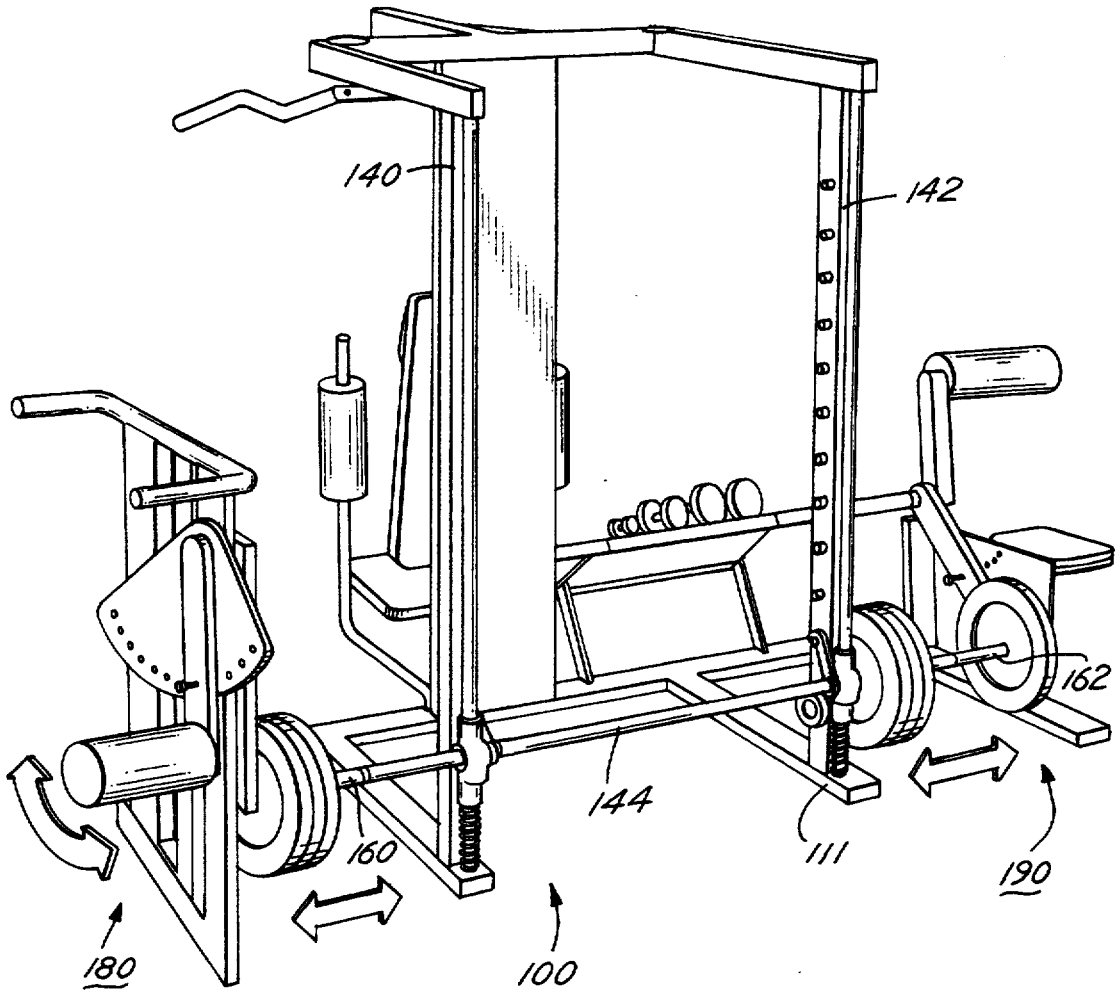
FIG. 4 is a perspective view of a second preferred embodiment of the invention.

Referring to FIG. 1, a first preferred embodiment of the invention is a bench device generally designated 10. A base tube 11 extends along a longitudinal tube axis 12 and provides a primary support element for the device 10. The tube is steel. A seat 14 is supported atop a steel seat support 16, which is welded to the base tube 11. The seat is vinyl covered, with a foam pad. A post 18 provides a bracket 20 for mounting of a leg lift member 22. Pads 24, 25, 26, 27, 28, 29, mounted on rods (not visible) on the post 18 and member 22, provide for typical leg lift exercises.

A steel outrigger member 30 extends across the base tube 11, in a direction transverse to the tube axis 12. The member 30 is generally horizontal, and yet arches over the base tube 11. The member 30 is welded to the base tube 11 where it touches the top of the base tube 11.

Two opposed, outrigger tubes 32, 34 define the transverse ends of and are welded to the outrigger member 30. The tubes 32, 34, also made of steel, are cylindrical, with central axes 36, 38 parallel to the longitudinal axis 12. Together, base tube 11, outrigger member 30, and outrigger tubes 32, 34 provide a stable base for the device 10.

An upright post 40 rises from the tube 32, and an upright post 42 rises from the tube 34. The posts are parallel to each other in their upper regions, and equidistant from the base tube 11 and device centerline. A V-shaped steel reinforcing member 39 welded to the posts 40, 42 and tube 11 braces and strengthens the tubes 40, 42.

The posts 40, 42 are square in cross-section, and have support brackets 41, 43, respectively, mounted in their open upper ends. Brackets 41, 43 provide support for a weight lifting bar 44, and are height adjustable relative to the posts 40, 42, through cooperation of pins such as pin 45 and pin openings such as 47.

The bar 44 has a length for two hand weight lifting, and more particularly, weight lifting with the hands at shoulder width and greater. The bar 44 rests on the posts 40, 42 outside the regions for users' hands.

A bench 46, vinyl over a foam pad over a back support, is mounted to the base tube 11 under the bar 44. The bench 46 is attached to the seat 14 at one end, and at the other, is mounted for adjustment to the base tube 11 via a telescoping bracket 48. As expected, the bench 46 is adjustable between horizontal and tilted positions.

As shown in the detail of FIG. 3, the posts 40, 42 include slanted, lower portions such as portion 50 of post 40. The portions 50 slant in the longitudinal direction of the axis 12, causing the upper regions of the posts 40, 42 to be shifted longitudinally relative to the lower portions 50.

Adjacent the lower portions 50 of the posts 40, 42, the outrigger tubes 32, 34 extend into pivots 52, 54. The pivots 52, 54 are movable relative to the tubes 32, 34, respectively, in planes perpendicular to the axes 36, 38 of the tubes 32, 34. The pivots may be formed of inner sleeves pivotable inside outer sleeves formed by the tubes 32, 34 as shown, or otherwise.

Steel storage posts 56, 58 are welded to and rise from the pivots 52, 54, respectively. As shown in FIG. 3, the storage posts such as post 56 are parallel to the upper portions of the posts 40, 42, in that they lie in the same plane perpendicular to the axis 12 in which the upper portions of the posts 40, 42 lie. The posts 56, 58 are pivotable perpendicular to the tubes 32, 34 and thereby the posts 40, 42 through the action of the pivots 52, 54.

Storage bars 60, 62 surmount the storage posts 56, 58, respectively, and extend generally toward the weight lifting bar 44. The storage bars 60, 62 are elongated and cylindrical, and define storage bar axes 64, 66 along the length of the bars 58, 60. As shown by comparing FIGS. 1 and 2, the axes 64, 66 vary in their positions relative to each other.

The storage bars 60, 62 are steel and welded to storage bar attachment brackets 68, 70, respectively, which brackets extend into the open upper ends of the posts 56, 58, respectively. Both the brackets 68, 70 and the open upper ends of the posts 56, 58 are square in cross-section, and the brackets 68, 70 slide within the ends. The brackets are adjustable relative to the posts 56, 58 via pins such as pin 72 and pin openings such as openings 74.

Lever action members 78, 80 interconnect the posts 56, 58 with the posts 40, 42. Each lever action member 78, 80 includes three links such as links 82, 84, 86 of member 78. Links 82, 86 are pivotably attached to the posts 56, 40, respectively, midway along the lengths of the posts. Link 84 is pivotably attached to the links 82, 86, and formed in a L-shape, for drawing the links 82, 86 and thereby the posts 56, 40 toward each other. More particularly, movement of the L-shaped link 84 in the direction of the arrow 88 in FIG. 1 results in the link 86 overlapping the link 82, as shown in FIG. 2. Such movement also results in the post 56 and the surmounted support bar 60 moving in the direction of the arrow 90 in FIG. 1. Movement of the link 84 in an opposite action results in movement of the post 56 and bar 60 in the opposite direction.

Referring to FIG. 2, the storage bars 60, 62 provide for storage of free weight plates such as plate 90. The storage bars receive and support the free weight plates through the centered, annular openings of the plates. Multiple weight plates may be loaded on the bars 60, 62.

In the positions of FIG. 2, the bars 60, 62 are immediately adjacent and in contact with the exposed ends of the weight lifting bar 44. Alignment as described makes possible the free movement of weight plates to and from the lifting bar 44 and the storage bars 60, 62. The bar 44 may have a hemispherical countour to its exposed ends, and the bars 60, 62 may have hemisphere receiving, cupped ends for seating of the bars 60, 62 with the bar 44. Alternatively, both the bars 60, 62 and the bar 44 may have squared ends. In either configuration, the bars 60, 62 and the bar 44 meet as shown in FIG. 2 with axes 64, 66, and 45 substantially aligned. Height adjustment of the support brackets 41, 43 may be met by height adjustment of the attachment brackets 68, 70, such that whatever height is chosen for the lifting bar 44, alignment of the axes of the bars 60, 62 and 44 may be achieved. Thus, in all positions of the brackets 41, 43, alignment of the bars 44, 60 and 62 may provide free movement of weights to and from the bar 44, and to and from the bars 60, 62, with only sliding motion of the weights being necessary.

Alternatively, in the position of FIG. 1, all weights stored on the storage bars 60, 62 may be stored in storage positions on the bars 60, 62, and away from the lifting bar 44. The lifting bar 44 is freed for standard use as a free weight barbell, for lifting of weights with the bar 44 completely free of the posts 40, 42 and all remaining parts of the device 10.

As can now be seen, the device 10 embodies a means, operatively connected to and associated with the weight lifting bar 44, the storage bars 60, 62, and the weight lifting bar support structure, for causing the storage bars and the weight lifting bar to occupy positions of alignment and proximity of the storage bars with the weight lifting bar, when desired. The device 10 also embodies such a means which further constitutes (a) means for changing the positions of the storage bars and the weight lifting bar relative to each o(her to and from positions of alignment and proximity of the storage bars with the weight lifting bar, (b) means for moving the storage bars between positions of storage and positions of function, the positions of storage being positions of movement away from the weight lifting bar, and the positions of function being positions of alignment and proximity with the weight lifting bar, (c) means for moving the storage bars between positions of storage and positions of function, the positions of storage being positions of movement away from and out of alignment with the weight lifting bar, (d) means for moving the storage bars between positions of storage and positions of function, the positions of storage being positions of movement away from and out of proximity with the weight lifting bar, and (e) means for pivoting the storage bars between positions of storage and positions of function, the positions of storage being positions of movement away from and out of proximity with the weight lifting bar.

Thus, the elongated storage posts are pivotally attached to the weight lifting bar support structure adjacent opposite ends of the weight lifting bar when the weight lifting bar is on the weight lifting bar support structure, and supporting the storage bars, and the storage posts are movable manually for moving the storage bars between positions of storage and positions of function, the positions of storage being positions of movement away from the weight lifting bar, out of proximity with the weight lifting bar and out of alignment with the weight lifting bar, and the positions of function being positions of alignment of the storage bar axes with the weight lifting bar axis, and of proximity of the storage bars with the ends of the weight lifting bar.

Further, the device 10 embodies means for manually actuating the means for causing the storage bars and the weight lifting bar to occupy positions of alignment and proximity of the storage bars with the weight lifting bar, when desired.

In a device 10 as constructed and arranged as shown, free weight plates may be moved manually off the weight lifting bar into storage on the storage bars, and alternatively, moved manually off the storage bars and onto the weight lifting bar, by sliding of the free weight plates along the storage bars and along the weight lifting bar while the axes of the storage bars are in alignment with the axis of the weight lifting bar are the storage bars are in proximity with the ends of the weight lifting bar.

Referring to FIG. 4, an alternative device 100 includes a weight lifting bar 144 on a bar support structure 111 with support posts 140, 142. Storage bars 160, 162 provide for the storage of weight plates off the bar 144, and also provide for alternate exercise through integration of the storage rods into alternate exercise stations 180, 190. The storage rods 160, 162 swing away from the bar 144 in planes perpendicular to the axis of the bar 144. As evident, this alternate construction may be merged with the construction of the first embodiment 10, or alternatively, the construction of the first embodiment 10 may be merged into the second embodiment 100.

The preferred embodiment of the invention, and the invention itself, are now described in such full, clear, and concise and exact detail as to enable a person of ordinary skill in the art to make and use the same. To particularly point out and distinctly claim the subject matters regarded as invention, the following claims conclude this specification. Except to the extent necessary to understand and give appropriate scope to the claims, the foregoing description is not intended to limit the invention. The singular includes the plural, unless otherwise specified.

What is claimed is:

1. An exercise device for use with free weight plates, comprising:

a weight lifting bar having a length sufficient to provide for two hand lifting of the bar;

a weight lifting bar support structure, for supporting the weight lifting bar;

storage bars, for storage of the free weight plates;

means, operatively connected to and associated with the weight lifting bar, the storage bars, and the weight lifting bar support structure, for causing the storage bars and the weight lifting bar to occupy positions of alignment and proximity of the storage bars with the weight lifting bar, the means for causing the storage bars and the weight lifting bar to occupy positions of alignment and proximity of the storage with the weight lifting bar being also means for positioning the storage bars between positions of storage and positions of function, the positions of storage being positions of movement away from and out of proximity with the weight lifting bar, and the positions of function being positions of alignment and proximity with the weight lifting bar, when desired;

whereby free weight plates may be moved manually off the weight lifting bar into storage on the storage bars, and alternatively, moved manually off the storage bars and onto the weight lifting bar, by sliding of the free weight plates along the storage bars and along the weight lifting bar while the storage bars and weight lifting bar are in alignment and proximity with each other.

2. An exercise device as in claim 1 in which the weight lifting bar defines a weight lifting bar axis along its length, and in which the storage bars define storage bar axes, the positions of alignment and proximity of the storage bars with the weight lifting bar being positions of alignment of the weight lifting bar axis and the storage bar axes.

3. An exercise device as in claim 1, the means for causing the storage bars and the weight lifting bar to occupy positions of alignment and proximity of the storage bars with the weight lifting bar, when desired, being also means for changing the positions of the storage bars and the weight lifting bar relative to each other to and from positions of alignment and proximity of the storage bars with the weight lifting bar.

4. An exercise device as in claim 1, the means for causing the storage bars and the weight lifting bar to occupy positions of alignment and proximity of the storage bars with the weight lifting bar, when desired, being also means for moving the storage bars between positions of storage and positions of function, the positions of storage being positions of movement away from the weight lifting bar, and the positions of function being positions of alignment and proximity with the weight lifting bar.

5. An exercise device as in claim 1, the means for causing the storage bars and the weight lifting bar to occupy positions of alignment and proximity of the storage bars with the weight lifting bar, when desired, being also means for moving the storage bars between positions of storage and positions of function, the positions of storage being positions of movement away from and out of alignment with the weight lifting bar, and the positions of function being positions of alignment and proximity with the weight lifting bar.

6. An exercise device as in claim 1, the means for causing the storage bars and the weight lifting bar to occupy positions of alignment and proximity of the storage bars with the weight lifting bar, when desired, being also means for moving the storage bars between positions of storage and positions of function, the positions of storage being positions of movement away from and out of proximity with the weight lifting bar, and the positions of function being positions of alignment and proximity with the weight lifting bar.

7. An exercise device as in claim 1, the weight lifting bar having a length sufficient to provide for shoulder-spaced two hand lifting of the bar.

8. An exercise device as in claim 1, the weight lifting support structure including a pair of spaced, upright posts for supporting the weight lifting bar.

9. An exercise device as in claim 1 in which the storage bars are elongated and cylindrical, and in which the support bars and weight lifting bar have approximately the same diameters.

10. An exercise device as in claim 1 further comprising means for manually actuating the means for causing the storage bars and the weight lifting bar to occupy positions of alignment and proximity of the storage bars with the weight lifting bar, when desired.

11. As exercise device of claim 1, wherein the means for positioning, is also a means for pivoting the storage bars.

12. An exercise device for use with free weight plates, the free weight plates being disks with centered, annular openings, the device comprising:

a weight lifting bar, which defines a weight lifting bar axis along its length, having a length sufficient to provide for shoulder-spaced two hand lifting of the bar, the bar adapted for supporting the free weight plates through the centered, annular openings of the plates;

a weight lifting bar support structure, for supporting the weight lifting bar, the weight lifting support structure including a pair of spaced, upright posts for supporting the weight lifting bar and exposing the ends of the bar outside the posts;

storage bars, for storage of the free weight plates, which define storage bar axes along their lengths, the storage bars adapted for supporting the free weight plates through the centered, annular openings of the plates;

elongated storage posts, pivotally attached to the weight lifting bar support structure adjacent opposite ends of the weight lifting bar when the weight lifting bar is on the weight lifting bar support structure, and supporting the storage bars, the storage posts movable manually for moving the storage bars between positions of storage and positions of function, the positions of storage being positions of movement away from the weight lifting bar, out of proximity with the weight lifting bar and out of alignment with the weight lifting bar, and the positions of function being positions of alignment of the storage bar axes with the weight lifting bar axis, and of proximity of the storage bars with the ends of the weight lifting bar; and means for manually actuating the means for causing the storage bars and the weight lifting bar to occupy positions of alignment and proximity of the storage bars with the weight lifting bar, when desired;

whereby free weight plates may be moved manually off the weight lifting bar into storage on the storage bars, and alternatively, moved manually off the storage bars and onto the weight lifting bar, by sliding of the free weight plates along the storage bars and along the weight lifting bar while the axes of the storage bars are in alignment with the axis of the weight lifting bar are the storage bars are in proximity with the ends of the weight lifting bar.

* * * * *